US007267042B2

(12) United States Patent
De Leonardis

(10) Patent No.: US 7,267,042 B2
(45) Date of Patent: Sep. 11, 2007

(54) HYDRAULIC MOTOR WITH TELESCOPIC PROPULSION MEMBERS RETAINED SEALINGLY AGAINST ASSOCIATED CONTACT SURFACES BY INTERNAL RESILIENT MEANS

(75) Inventor: Loris De Leonardis, Bologna (IT)

(73) Assignee: Parker Calzoni S.R.L., Anzola Dell'Emilia (IT)

( * ) Notice: Subject to any disclaimer, the term of this patent is extended or adjusted under 35 U.S.C. 154(b) by 263 days.

(21) Appl. No.: 11/150,922

(22) Filed: Jun. 13, 2005

(65) Prior Publication Data

US 2005/0279206 A1 Dec. 22, 2005

(30) Foreign Application Priority Data

Jun. 16, 2004 (IT) ..... MI2004A1219

(51) Int. Cl.
*F01B 13/06* (2006.01)

(52) U.S. Cl. ..... 92/72; 92/119; 92/130 C

(58) Field of Classification Search ..... 92/72, 92/119, 130 C, 148; 91/494
See application file for complete search history.

(56) References Cited

U.S. PATENT DOCUMENTS 3,577,830 A 5/1971 Ortelli 5,967,018 A * 10/1999 Breveglieri ..... 92/72

FOREIGN PATENT DOCUMENTS

| | | |
|---|---|---|
| DE | 4406803 A1 | 9/1995 |
| EP | 0266806 A | 5/1988 |
| EP | 0851119 A | 7/1998 |

* cited by examiner

*Primary Examiner*—F. Daniel Lopez
(74) *Attorney, Agent, or Firm*—Timothy J. Keefer; Seyfarth Shaw LLP

(57) ABSTRACT

Hydraulic motor with propulsion members (10) positioned between a cam (3) associated with a shaft (2) and a reaction element (1*b*), said propulsion members (10) consisting of two elements (11,12), i.e. an internal element (12) and external element (11), telescopically slidable with respect to each other in a radial direction and respectively provided with annular bearing edges (11*a*,12*a*) kept pressed against corresponding contact surfaces (3*a*, 1*a*) of said cam (3) and said reaction element (1*b*) via respective resilient means (16), the resilient means associated with the external element (11) of the propulsion member being arranged outside the said element, characterized in that the resilient means (16) associated with the internal element (12) are arranged inside the propulsion member (10) and positioned in the radial direction between said internal element (12) and associated means (52,55) for mechanically retaining them.

18 Claims, 2 Drawing Sheets

HYDRAULIC MOTOR WITH TELESCOPIC PROPULSION MEMBERS RETAINED SEALINGLY AGAINST ASSOCIATED CONTACT SURFACES BY INTERNAL RESILIENT MEANS

The present invention relates to a hydraulic motor with propulsion members retained against corresponding contact surfaces by resilient means inside said propulsion members and positioned between the latter and associated means performing a mechanical retaining action in the radial direction.

It is known in the technical sector relating to the construction of engines or motors with propulsion members moved by means of a fluid supply and therefore generally defined as hydraulic that there exists the possibility of forming the said propulsion members using a cylinder and a piston which are telescopically coupled together so as to be displaceable relative to each other, upon rotation of a cam associated with the driving shaft, thus imparting a thrust to the said shaft.

Said propulsion members may be arranged radially or obliquely.

It is also known that, in the case of radial engines or motors, one of the problems posed by said propulsion members consists in the need to keep the end edge of the cylinder and the piston sealingly adherent, respectively, to the said cam and a reaction element consisting of a cap fixed to the engine housing so as not to cause seepage of fluid during the relative travel movement of piston and cylinder.

One of the solutions commonly used to obtain this sealing effect consists in the insertion, inside each propulsion member, of a resilient element consisting of a helical spring arranged coaxially with the propulsion member and able to exert a thrust against corresponding internal projections of the cylinder and piston so as to press the latter against the associated bearing surfaces.

An example of this type of actuating system is known from the U.S. Pat. No. 3,577,830.

This solution, however, has certain drawbacks including those consisting in the dynamic stressing which the spring is subject to during the travel movement of the piston with respect to the cylinder, resulting in the need to design the said spring with excessively large dimensions, producing a strong thrust on the sliding contact surfaces, with consequent greater wear thereof.

In addition to this, the presence of the spring and the associated projections supporting it inside the cylinder prevents a reduction in the volume of fluid which cannot flow out of the cylinder at the end of the compression phase (so-called "dead volume"), increasing the problems of replacement of the said fluid with new fluid supplied by the delivery ducts.

The technical problem which is posed, therefore, is that of providing a hydraulic motor provided with means for mechanically retaining each propulsion member against respective bearing and contact surfaces where the hydraulic seal preventing seepage of the thrusting fluid must be ensured.

Within the scope of this problem a further requirement is that said mechanical retaining means should envisage resilient means acting on the propulsion members with a thrust in a direction parallel to that of their longitudinal axis, which is independent of the working (compression/discharge) phase of the said propulsion member.

In addition to this it is required that said resilient retaining means should be easy and inexpensive to realize and install on motors of the known type and should allow the motor to be used also as a pump.

These technical problems are solved according to the present invention by a hydraulic motor with propulsion members positioned between a cam associated with a shaft and a reaction element, said propulsion members consisting of two elements, i.e. an internal element and external element, telescopically slidable with respect to each other in a radial direction and respectively provided with annular bearing edges kept pressed against corresponding contact surfaces of said reaction element and said cam via respective resilient means, said resilient means associated with the external element of the propulsion member being arranged outside the said element and the resilient means associated with the internal element being arranged inside the propulsion member and positioned in the radial direction between said internal element and associated means for mechanically retaining them.

Further details may be obtained from the following description of a non-limiting example of embodiment of the invention provided with reference to the accompanying drawings in which.

Figure 1:
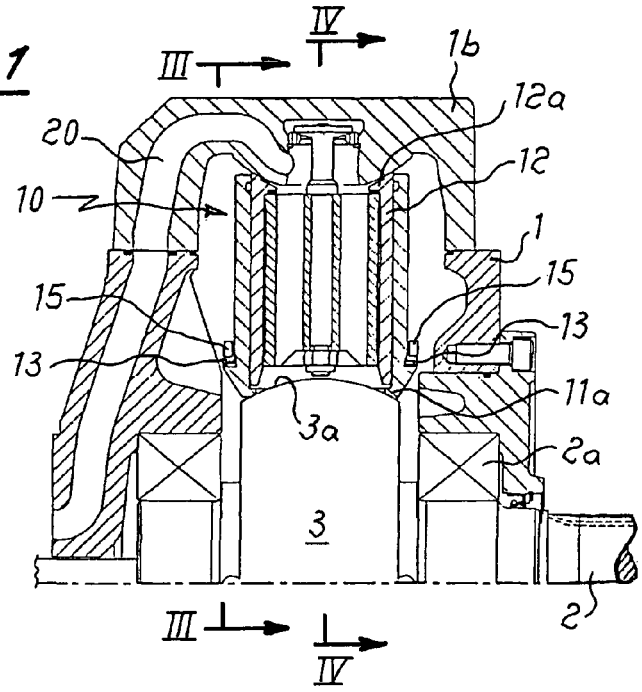
FIG. 1 shows a partial schematic cross-section through a radial motor according to the invention along a plane perpendicular to the axis of the driving shaft.

As shown, the hydraulic motor according to the invention in the version with radial propulsion members comprises a casing 1 housing internally the shaft 2 mounted on bearings 2*a* and carrying the cam 3 on which the propulsion members 10 act radially.

Said propulsion members 10 in turn consist of a cylinder 11, one of the two end edges of which rests on the external surface 3*a* of the said cam 3, and of a piston 12 telescopically slidable in a radial direction inside the cylinder 11 and having one of the two end edges bearing against a spherical surface 1*a* formed inside the covers 1*b* constrained to the casing 1 of the motor via suitable fixing means.

The edge of said cylinder 11 and said piston 12 resting on the respective contact surfaces 1*a* and 3*a* of the cover 1*b* and the cam 3 (FIG. 2) substantially consists of an annular edge 11*a*, 12*a* provided with a contact surface 11*b*, 12*b* parallel to the surface of the cam.

In the zone of contact between the cylinder 11 and the cam 3 said retaining elements consist of: a slider 13 with a coaxial hole 13*a*, having a diameter slightly greater than the external diameter of the cylinder 11 so as to allow the latter to pass through it as far as an end-of-travel stop consisting of a tooth 11*c* extending outwards and able to engage with the radial retaining means described below.

Figure 5:
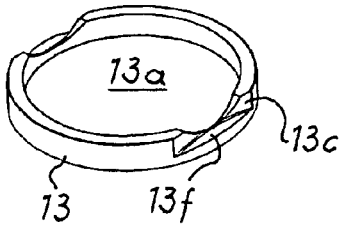
FIG. 5 shows an enlarged detail of the slider for retaining the cylinder against the cam.
Figure 3:
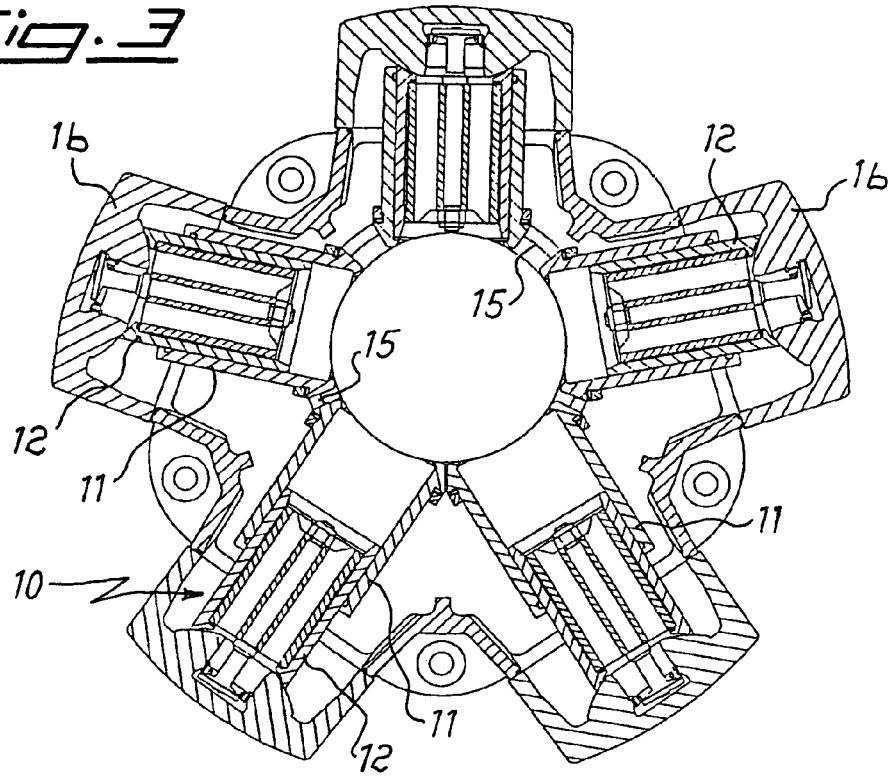
FIG. 3 shows a cross-section along the plane indicated by III-III in FIG. 1.
Figure 4:
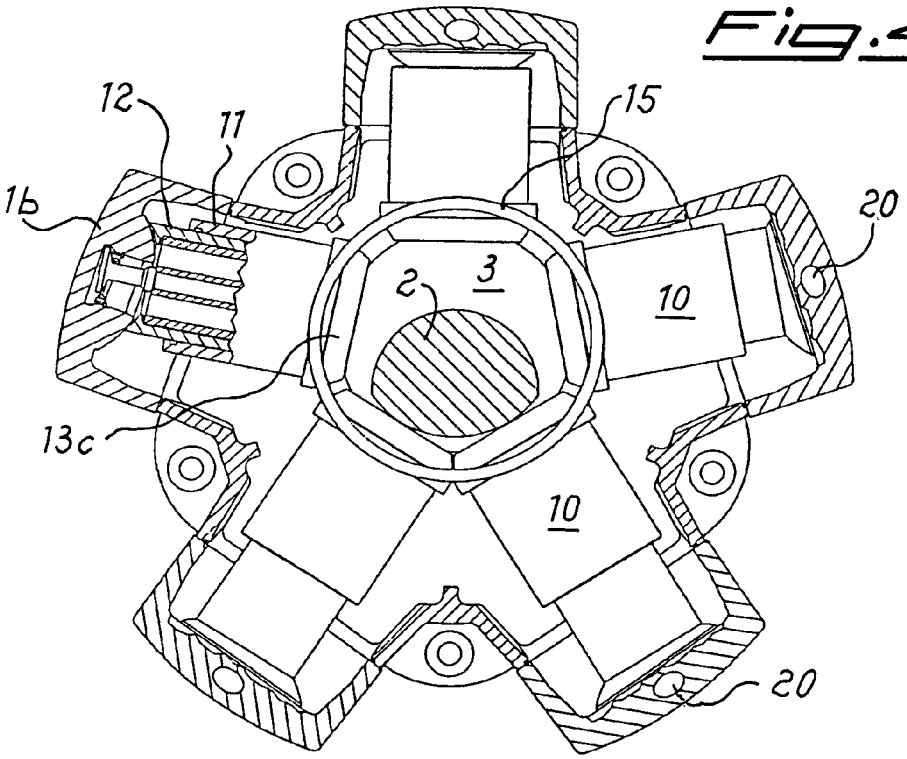
FIG. 4 shows a cross-section along the plane indicated by IV-IV in FIG. 1.

Said slider 13 has, moreover, (FIG. 5) at least one pair of opposite and parallel depressions 13*c* with a cylindrical surface 13*f* able to form an engaging seat for a ring 15 (FIGS. 3 and 4) arranged around each edge of all the sliders 13 retaining each cylinder 11 and having its centre on an axis parallel to that of the driving shaft 2 and passing through the centre of the spherical cam 3.

In this way the opposite rings 15 radially retain all the sliders 13 which, in turn, keep the associated cylinder 11 in bearing contact against the cam 3 during rotation thereof.

In order to maintain adherence between the slider 13 and the base 11*a* of the cylinder 11, a resilient element, in the example consisting of an undulating spring 16, is positioned between them, said spring being designed to impart a radial force resulting in relative contact between the contact surfaces 11*b* and 3*a*, which force is constant and independent of the working phases of the propulsion member 10.

Figure 2:
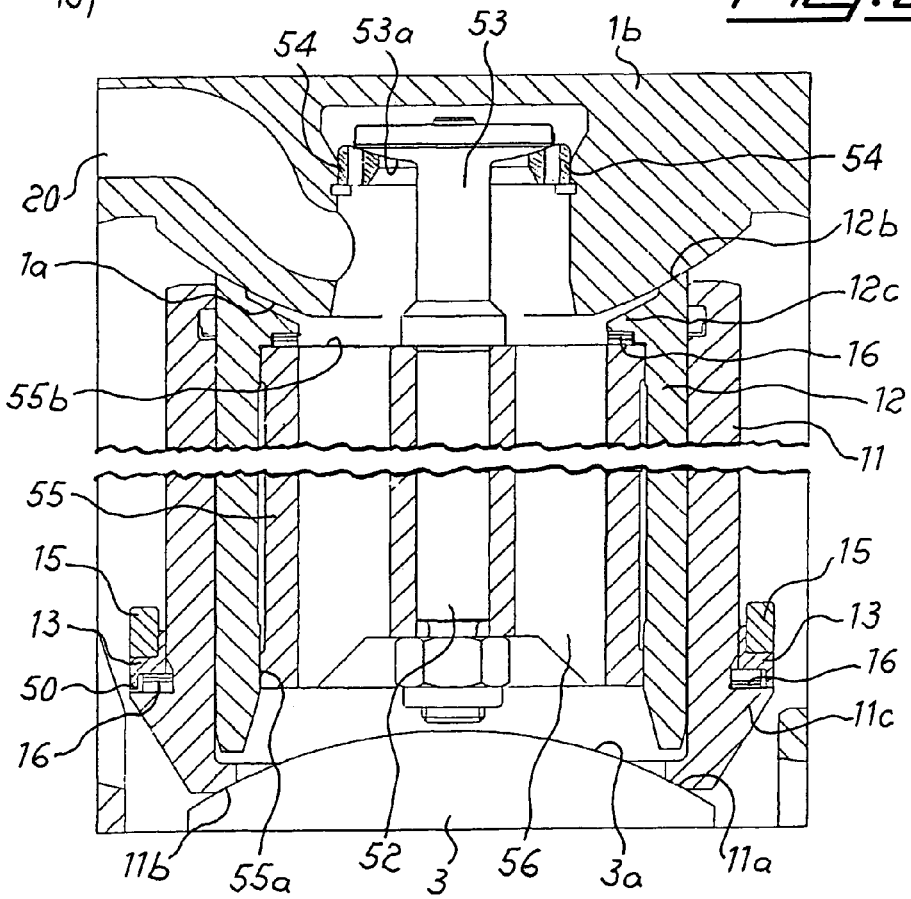
FIG. 2 shows an enlarged detail of a propulsion member of the motor according to FIG. 1.

As can be seen from FIG. 2, the spring 16 remains inserted inside a seat formed by the bottom part of the ring 13 which forms in this way an end-of-travel element for compression of the spring which is prevented from being compressed beyond its own yield point, with advantages as regards the durability and reliability of the device.

In the zone of contact between piston 12 and cover 1*a* the retaining elements consist of a pin 52 provided with a head 53 which has a spherical surface 53*a* resting on corresponding support elements 54 fixed to the casing 1*a* so that the head 53 itself forms a ball joint; the shank of the pin 52 has a cylindrical body 55 with a diameter such that its side surface 55*a* makes contact with the side surface of the piston 12 and an external end surface 55*b* arranged below an annular tooth 12*c* of the cylinder 12 projecting towards the inside thereof.

Resilient means in the form of a spring 16 are arranged between the cylindrical body 55 and the said annular tooth 12*c* so as to ensure constant adherence of the contact surfaces 12*b*, 1*a* during the various working phases of the propulsion member 10; the piston 12 furthermore supports, similar to that occurring in the bottom part of the ring 13, an end-of-travel element 50 for preventing the spring 16 from being stressed beyond its yield point.

The cylindrical body 55 also has, formed therein, the ducts 56 for conveying the fluid supplying the motor.

It is therefore obvious how the retaining devices according to the present invention allow two main advantages to be achieved compared to the known art; they in fact allow the resilient means to be no longer dependent upon the dynamic loads resulting from the relative travel movement of the piston and cylinder of the propulsion member with each rotation of the cam, allowing moreover filling of the chamber of the cylinder 11 with high-volume and low-weight bodies 55 able to limit the dynamic imbalance and reduction in the fluid dead volume.

In addition to this, the internal retaining devices according to the invention allow a larger section of contact to be obtained between the cylinder 11 and the piston 12 in the fully extended condition of the propulsion member 10, this factor being important for avoiding seizing during the return movement into the minimum relative extension of the two components.

The solution described above, which envisages engagement of cylinders and pistons with the associated contact surfaces, also allows the cylinders to perform a fluid suction function without loss of adherence to the said surfaces, and the apparatus is therefore able to be operated as a pump instead of as a motor.

The invention claimed is:

1. Hydraulic motor with propulsion members positioned between a cam associated with a shaft and a reaction element, said propulsion members consisting of two elements i.e. an internal element and external element, telescopically slidable with respect to each other in a radial direction and respectively provided with annular bearing edges kept pressed against corresponding contact surfaces of said reaction element and said cam via respective resilient means, said resilient means associated with the external element of the propulsion member being arranged outside the said element, characterized in that the resilient means associated with the internal element are arranged inside the propulsion member and positioned in the radial direction between said internal element and associated means for mechanically retaining them.

2. Motor according to claim 1, wherein said propulsion members are arranged in radial directions with respect to the axis of the driving shaft.

3. Motor according to claim 1, wherein said retaining action of the propulsion members is generated in the radial direction.

4. Motor according to claim 1, wherein said reaction element for the internal element of the propulsion member is the cover of the motor.

5. Motor according to claim 4, wherein said cover has spherical contact and sliding seats for the internal element of the propulsion member.

6. Motor according to claim 1, wherein said resilient means consist of springs.

7. Motor according to claim 6, wherein said springs are flexural springs.

8. Motor according to claim 6, wherein said springs are flexural/torsional springs.

9. Motor according to claim 6, wherein said springs are Belleville springs.

10. Motor according to claim 1, wherein said springs are associated with coaxial means able to form an end-of-travel stop for compression of the said spring.

11. Motor according to claim 1, wherein said means for retaining in a radial direction the internal element of the propulsion member consist of a coaxial cylindrical body, inside the piston and connected to the casing of the motor by means of a coaxial pin, and an annular tooth of the cylinder projecting towards the inside thereof.

12. Motor according to claim 11, wherein said resilient means are positioned between the external end surface of the said cylindrical body and the internal end surface of said tooth of the internal element of the propulsion member.

13. Motor according to claim 11, wherein said pin has a head with a spherical surface able to oscillate on associated supports integral with the motor.

14. Motor according to claim 11, wherein ducts for conveying the fluid supplying the motor are formed inside the cylindrical body.

15. Motor according to claim 1, wherein said means for mechanically retaining in a radial direction the external element of the propulsion member comprise at least one slider coaxial with the propulsion member and engaged with the said annular edges thereof, and at least one pair of elements for constraining the said slider in the radial direction.

16. Motor according to claim 15, wherein said slider for retaining the cylinder has a hole for coaxial insertion on the cylinder and at least one pair of opposite and parallel depressions with a flat bottom surface.

17. Motor according to claim 15, wherein said elements for retaining the slider of the cylinder consist of a pair of rings having their centre on an axis parallel to that of the driving shaft and passing through the centre of the spherical cam and engaged on each of said depressions in said sliders.

18. Motor according to claim 1, wherein it is operated as a pump.

* * * * *